United States Patent [19]

Brewer

[11] 4,070,049

[45] Jan. 24, 1978

[54] SECURITY DOOR GUARD

[76] Inventor: Jack J. Brewer, 5012 Oak Timbers Court, Grapevine, Tex. 76051

[21] Appl. No.: 646,873

[22] Filed: Jan. 5, 1976

[51] Int. Cl.[2] ..... E05C 17/34

[52] U.S. Cl. ..... 292/263

[58] Field of Search ..... 292/263, 338, 339, 277, 292/DIG. 15; 403/100, 102

[56] References Cited

U.S. PATENT DOCUMENTS

| | | | |
|---|---|---|---|
| 528,146 | 10/1894 | Case | 292/263 |
| 1,851,630 | 3/1932 | Johnson | 292/263 |
| 2,738,120 | 3/1956 | Fuhriman | 403/102 X |
| 3,563,592 | 2/1971 | Preston | 292/263 |

*Primary Examiner*—Richard E. Moore
*Attorney, Agent, or Firm*—H. Mathews Garland

[57] ABSTRACT

A security door guard in the form of a foldable and telescoping brace connected between the inside face of a door and an adjacent supporting surface such as a wall. The brace includes two tubular sections hinged in the middle and connectible at opposite ends with the inside face of the door and the adjacent wall surface to provide a rigid prop or brace to prevent unauthorized opening of the door. The section of the brace connected with the door includes a telescoping portion which is shown in two forms for allowing partial opening of the door from the inside.

3 Claims, 14 Drawing Figures

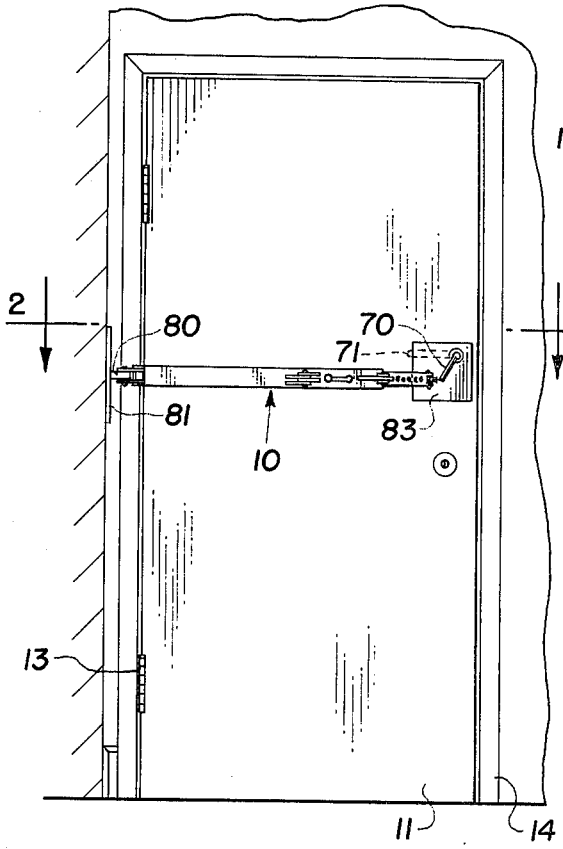
Fig. 1
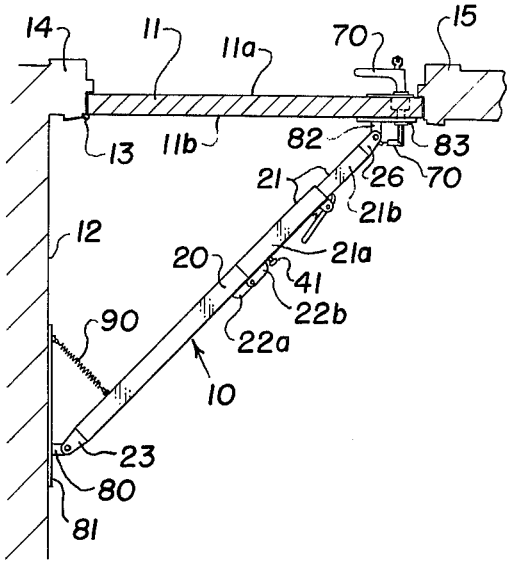
Fig. 2
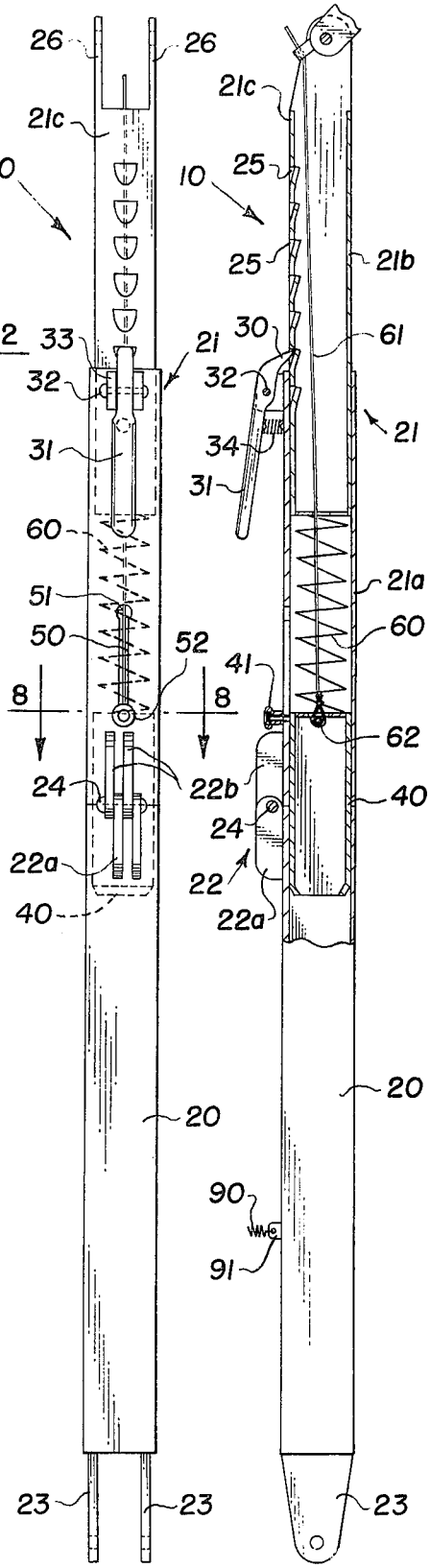
Fig. 3
Fig. 4

SECURITY DOOR GUARD

This invention relates to security door guards and more particularly relates to a prop or brace for use with a door to prevent unauthorized entry through the door from the outside face of the door.

Security has become a matter of very serious concern in both residential and business areas. Development of various devices to minimize unauthorized entry through doors and windows has developed into a matter of great importance. A number of props or braces for doors have been proposed in issued United States patents. For the most part such braces function between the inside face of the door and the floor which presents several major problems. Some of the devices are inoperable where carpeting is placed on the floor. The extension of low level brace members from the face of a door to the floor places an obstruction at the foot and ankle level of occupants of the structure entered through the door so that such devices are inherently dangerous to the occupants walking around within the structure in the immediate vicinity of the door. Other brawbacks which have been found in the known devices include inability to partially open the door for purposes of communicating with someone on the outside of the door.

Accordingly it is an important object of the present invention to provide a new and improved form of security door guard.

It is another object of the invention to provide a device to prevent unauthorized entry through a door in the form of a brace or prop.

In is another object of the invention to provide a security door guard which does not extend from the inside face of the door to the floor.

It is another object of the invention to provide a security door guard which permits partial opening of the door.

In accordance with the invention there is provided a security door guard which comprises a brace or prop including two sections formed of tubular members hinged together at the middle of the device and connectible at opposite ends between the inside face of a door and an adjacent surface such as a wall. The section connected with the door includes a telescoping member which allows partial openings of the door while retaining the prop or brace feature which may continue to function to prevent full entry through the door. In one form of the device the telescoping section for partial door opening has a spring to extend the section for reclosing the door and a ratchet type lever to control the degree of door opening. In another form the telescoping section retracts a fixed distance and must be manipulated by hand to close the door.

Preferred embodiments of a security door guard incorporating the features of the invention together with its objects and advantages will be better understood from the following detailed description taken in conjunction with the accompanying drawings wherein:

FIG. 1 is a view in elevation showing a security door guard incorporating the features of the invention connected between the inside face of a door and an adjacent wall surface running at a ninety degree angle with the door;

FIG. 2 is a view in section and elevation taken along the line 2—2 of FIG. 1;

FIG. 3 is an enlarged longitudinal view in elevation of the security door guard removed from the door;

FIG. 4 is a longitudinal view in section and elevation of the door guard as shown in FIG. 3 taken at a ninety degree angle to the view of FIG. 3;

Figure 9:
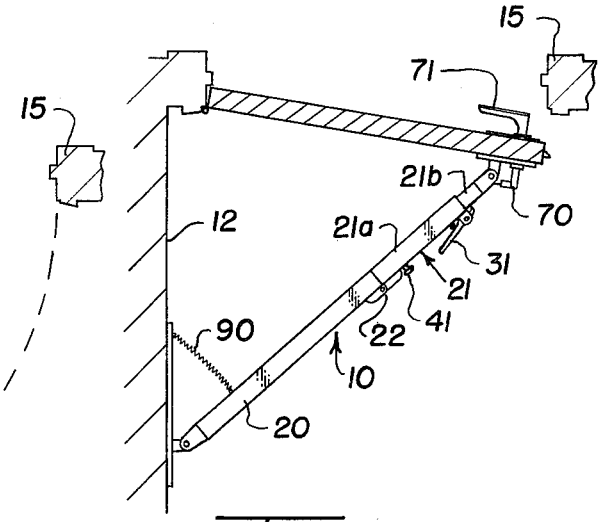
Figure 8A:
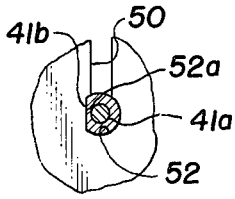
FIG. 8 is an enlarged view in section and elevation taken along the line 8—8 of FIG. 3 showing the latching knob and internal locking sleeve which operates between the door guard sections for releasing the sections to fold and for locking the sections together to form a rigid unitary member of the guard.
Figure 8:
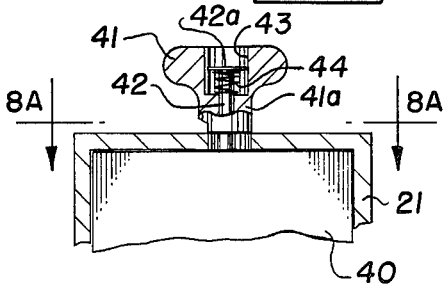
Figure 10:
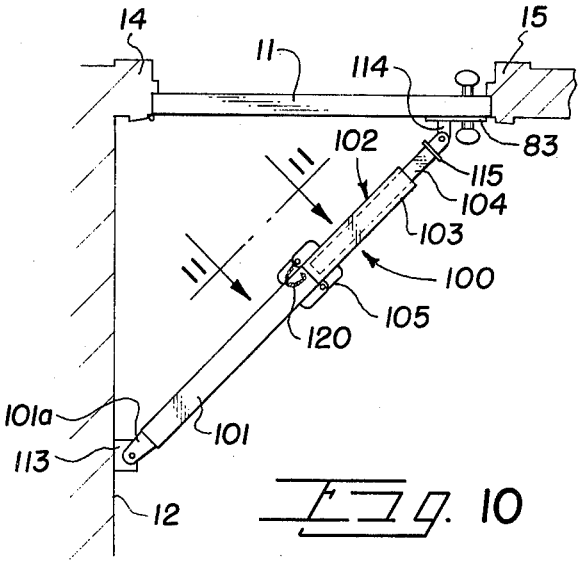
Figure 12:
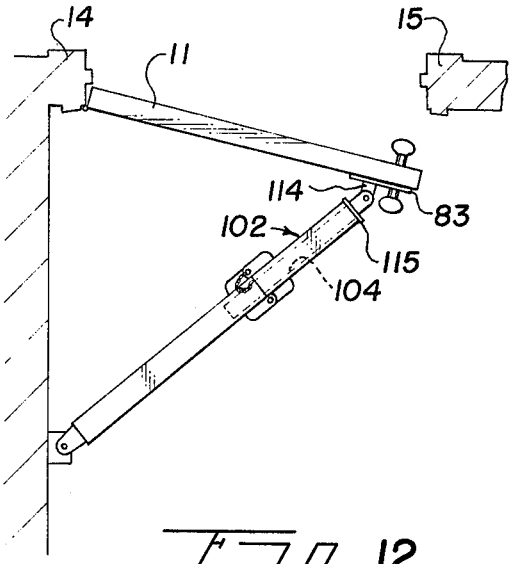
Figure 11:
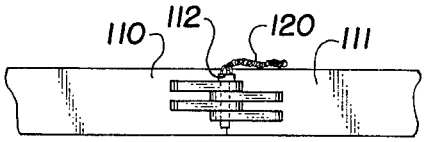

FIG. 8-A is a fragmentary view in section along the line 8A—8A of FIG. 8;

FIG. 9 is a view similar to FIG. 2 showing the door partially open;

FIG. 10 is a top view in elevation of another form of door brace embodying the invention, showing the door held fully closed by the device;

FIG. 11 is an enlarged view of the inside connection between the brace sections;

FIG. 12 is a view similar to FIG. 10 with the door partially open; and

Figure 13:
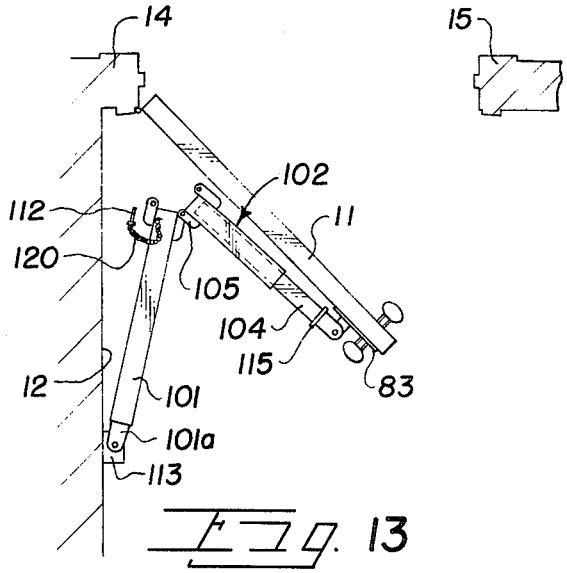

FIG. 13 is another view similar to FIG. 10 with the brace partially folded such as when fully opening the door.

Referring to FIG. 1 a security door guard 10 incorporating the features of the invention is shown connected between the inside face of a door 11 and an inside wall surface 12 for bracing or propping the door against unauthorized entry from the outside of the door. The door 11 is secured by means of a pair of vertically spaced hinges 13 connected between the door and a door frame 14 mounted in an outside wall 15. In the position shown in FIGS. 1 and 2 the security door guard 10 braces or props the door 11 against unauthorized entry through the door from the outside face **11*a* of the door. The security door quard is foldable to allow full opening of the door as illustrated in FIG. 5 and permits a partial opening of the door while protecting against unauthorized entry as represented in FIG. 9**.

Figure 5:
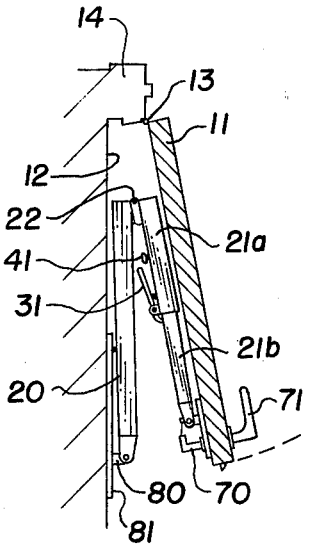
FIG. 5 is a view in section and elevation similar to FIG. 2 illustrating the door guard in a folded relationship as when the door is fully open.
Figure 6:
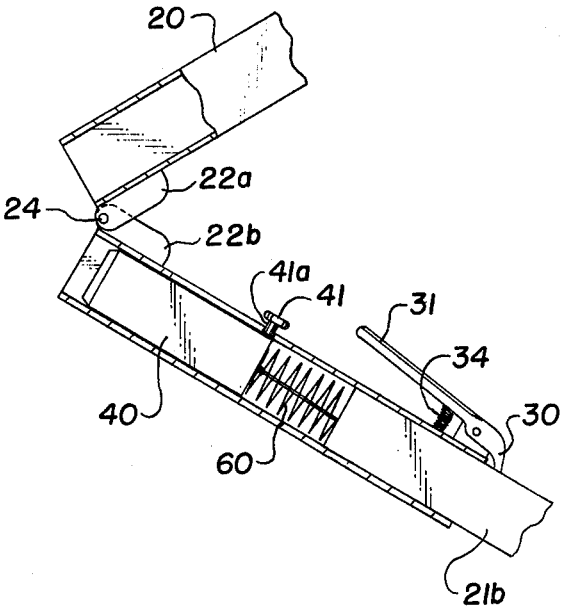
FIG. 6 is an enlarged view in section and elevation showing the position of the internal locking sleeve within the door guard sections when the door guard is released to fold.

Referring to FIGS. 3 and 4, the security door guard 10 includes two sections 20 and 21 which are connected together by a hinge 22 which permits the door guard to fold as shown in FIGS. 5 and 6. The section 20 has a pair of endwardly extending spaced hinge members or brackets 23 for mounting the door guard with the wall face 12. The door guard section 20 has a pair of spaced hinge members **22*a* which mesh with a pair of similar hinge members 22*b* on the door guard section 21. The hinge members 22*a* are pivotally connected with the hinge members 22*b* by a hinge pin 24 thereby permitting the guard sections 20 and 21 to fold from the straight longitudinal relationship shown in FIGS. 3 and 4**.

The security door guard section 21 is formed by telescoping members **21*a* and 21*b*. The member 21*b* telescopes into the member 21*a* to permit the door 11 to partially open as represented in FIG. 9. The member 21*b* has one side face 21*c* provided with a plurality of longitudinally spaced locking recesses 25 which are engageable by a pawl 30 secured along the corresponding face of the member 21 to lock the member 21***b* from further telescoping into the member 21*a* at the various positions of the locking recesses 25. The pawl 30 has an operating handle 31 and is secured by a hinge pin 32 to spaced brackets 33 on the side of the member 21. A spring 34 is confined between the face of the handle 31 and the adjacent side face of the member 21*a* to bias the handle 31 and the pawl 30 in a clockwise direction as seen in FIG. 4 so that the locking end of the pawl 30 is urged into the nearest locking recess 25. It will be evident from FIG. 4 that with the pawl 30 engaged in the nearest locking recess 25 the member 21*b* cannot telescope farther into the member 21*a* of the security door guard section 21.

The security door guard sections 20 and 21 are locked against folding by an internal sleeve 40 which is movable between a first position as shown in FIGS. 3 and 4 in which the sleeve telescopes into abutting end portions of sections 20 and 21 at the hinged connection between the sections thereby locking the sections against folding and a second moved position in which the locking sleeve 40 is retracted into the section 21 as shown in FIG. 6 to permit the sections 20 and 21 to fold. The locking sleeve 40 is a rectangular tubular member which has the shape of the inside of the sections 20 and 21 and forms a sliding fit within the sections 20 and 21 so that the locking sleeve may move between the positions of FIGS. 3 and 4 and of FIG. 6. The longitudinal position of the locking sleeve 40 is controlled by the operating knob 41 which is shown in enlarged detail in FIGS. 8 and 8-A. The knob 41 is mounted on a rigid pin 42 which is secured at an inward end with the side of the sleeve 40 at the end of the sleeve located in the section 21. The knob 41 serves both an operating and a locking function to the sleeve 40. The knob 41 has an outwardly opening central recess 43 which receives the outward end of the pin 42. The pin 42 has an enlarged head 42*a* within the knob recess 43. A spring 44 is confined between the head 42*a* and the inside end of the recess 43 in the knob so that the spring 44 biases the knob 41 inwardly toward the locking sleeve 40. The shaft 41*a* of the knob 41, as shown in FIG. 8-A, has a flat side face 41*b* which serves to permit the knob 41 to assume an outward release position or an inward locking position. The section 21 has a longitudinal slot 50 which has locking recesses 51 and 52 at opposite ends thereof to permit the locking sleeve 40 to move between locking and release positions and to permit the sleeve to be locked at opposite end positions. The locking recess portion 52 at the lower end of the slot as viewed in FIGS. 3 and 4 has a flat side portion 52*a*, as seen in FIG. 8-A, to cooperate with the flat side face 41*b* of the knob shaft 41*a*. When the operating knob 41 is pulled outwardly against the spring 44, the knob is used to shift the locking sleeve 40 from the first locking position of FIGS. 3 and 4 at which the sleeve holds the hinged members 20 and 21 against folding to a second end position as illustrated in FIGS. 6 at which the members 20 and 21 are released to fold. The knob 41 slides along the outer face of the section 21 along the slot 51. The pin 42, of course, moves longitudinally along the slot 50 between the locking recesses 51 and 52. At the upper locking recess 51 the pin 41 may move inwardly into the recesses 51 to lock the sleeve 40 at the release position. Similarly, the knob shaft 41*a* may move inwardly into the locking recess 52 at the lower end position of the sleeve 40 and the knob 41 for locking the sleeve 40 at the lock position of FIGS. 3 and 4. At this position the knob 41 must be rotated so that the face 41*b* is aligned with the recess face 52*a* to permit the knob shaft to enter the recess 52 at only a single position of rotation. The use of the flat surfaces on the knob shaft 41*a* and the locking recess 52*a* permits the operating knob 41 to be at the lower end position at the locking recess 52 while at the same time being either inwardly at a locking position within the recess or outwardly at a release position which allows access through the door from the outside as discussed hereinafter. With the knob rotated to align the surfaces 41*b* of the knob shaft and 52*a* of the locking recess 52, the knob 41 is forced inwardly by the spring 44 to the locking position in the recess 52. If, however, the knob 41 is rotated slightly so that the surfaces 41*b* and 52*a* are not aligned, then the shaft 41*a* cannot move into the recess 52 and therefore while the knob remains at the lower locking position at the recess 52 the knob can slide upwardly along the slot 50 if moved by a force.

As shown in FIGS. 3 and 4, a spring 60 is confined within the tubular section 21*a* of the guard section 21 between the inside end face of the telescoping member 21*b* and the outter end face of the locking sleeve 40. The spring 60, therefore, tends to urge the locking sleeve 40 to the locking position of FIGS. 3 and 4 and also to urge the member 21*b* outwardly or away from the member 21*a* to urge the door back toward a closed position when it is partially open as in FIG. 9. An operating wire 61 extends from a pin in the locking sleeve 40 through the members 21*a* and 21*b* and outwardly from the outer end of the member 21*b* to a connection with an internal lever 70 on a doorknob 71 of the door 11. The purpose of the operating wire 61 is to retract the locking sleeve 40 from the locking position of FIGS. 3 and 4 to the release position of FIG. 6 when the operating knob 41 is at an outer release position and the doorknob 71 is operated from the outside of the door to gain access from the outside through the door.

The inward end of the security door guard is connected by the hinge members 23 with corresponding members 80 on a mounting plate 81 secured along the inside wall face 12. Similarly, the outer end of the security door guard is connected by the hinge member 26 on the member 21*b* with hinge brackets 82 mounted on a plate 83 secured along the inside face of the door 11. A spring 90 is connected from a bracket 91 on the member 20 to the plate 81 to urge the door guard section 20 toward the wall face 12 so that when the locking sleeve 40 is retracted to the release position, the door guard will fold the wall surface 12 as the door 11 is opened.

In operation, when the door 11 is fully closed and locked and the occupant of the building is within the building and wants to guard against unauthorized entry through the door from the outside, the security door guard is set or armed as shown in FIGS. 1 – 4, 7, and 9. The locking sleeve 40 is fully extended into the section 20 so that about half of the sleeve 40 is within the section 21 and the other half of the sleeve 40 is within the section 20 at the adjacent ends of the sections 20 and 21 thereby rigidly holding the sections 20 and 21 against folding. At this position of the sleeve 40 the operating knob 41 is rotated as shown in FIG. 8-A so that the knob shaft 41*a* enters the locking recess 52 at the lower end of the slot 50 thereby locking the knob 41 at the lower end position as represented in FIGS. 3 and 4 so that the sleeve 40 is held at the locking position within the sections 20 and 21. At this position of the locking sleeve 40 the security door guard thereby becomes a rigid member which cannot fold and will brace or prop the door 11 at its closed position. The door thereby cannot be opened unless the door is literally torn down and the door and brace destroyed. If the occupant desires to partially open the door to speak to someone outside the door or pass a small package through the door, the pawl lever 30 is slightly depressed so that the section 21*b* may telescope inwardly into the section 21*a* allowing the door to move slightly open as shown in FIG. 9. The degree of opening is determined by which of the locking recesses 25 the pawl 30 is allowed to enter. The pawl 30 upon entry into the desired recess 25 will prevent further opening of the door. As the door is opened the spring 60 is compressed. Thus, if the pressure holding the door open either by the occupant or by the person outside the door is released, the spring 60 will urge the door back to a closed position. The direction along which the section 21*b* is urged by the spring 60 will cause the pawl 30 to be cammed out of the locking recesses 25 as the section 21*b* is extended to return the door to the closed position. Therefore, partial opening of the door is allowed without full entry with the door being held partially open by the pawl 30 engaging one of the locking recesses 25.

When the occupant desires to fully open the door, the operating knob 41 is pulled outwardly against the spring 44 retracting the knob shaft 41*a* from the locking recess 52 along the side face 21*c* of the section 21*b*. The knob 41 is then moved in the direction of the door along the recess 50 until the knob reaches the upper recess 51 which is the recess along the section 21*b* nearest the door 11. The knob 41 is released so that the spring 44 urges the knob shaft 41*a* into the recess 51. The movement of the locking knob 41 to the position of the recess 51 retracts the locking sleeve 40 fully into the section 21*a* so that the locking sleeve is moved to the release position of FIG. 6 fully withdrawing the locking sleeve from the connection between the sections 20 and 21. With the locking sleeve 40 thereby fully withdrawn as in FIG. 6, the guard sections 20 and 21 may fold inwardly toward the inside door face and the wall surface 12. The spring 90 urges the section 20 toward the wall face 12 so that as the door is opened inwardsly on the hinges 13 the security door guard folds to the position of FIG. 5 allowing the full opening of the door.

When it is desired to again shut the door, the door is simply swung back to the position of FIG. 2 with the security door guard returned to the straight relationship illustrated. The operating knob 41 is returned downwardly along the slot 50 or in terms of the FIGS. 1 and 2, horizontally toward the wall surface 12 until the operating knob reaches the locking recess 52 at which point the locking sleeve 40 is extended into the guard section 20 so that the security door guard is again held rigid to brace the door against opening.

The security door guard 10 may be set by the occupant upon leaving through the door to allow re-entry by operation of the knob 71 from the outside face of the door. The operating knob 41 is rotated so that the face 41*b* on the knob shaft is misaligned from the locking recess surface 52*a*. When the door is shut and locked from the outside the security door guard is pulled into the straight relationship of FIGS. 3 and 4 so that the spring 60 expands to urge the locking sleeve 40 into the locked relationship between the sections 20 and 21. With the operating knob 41 misaligned with the locking recess 52, the knob 41 cannot move inwardly to the locked position when the knob shaft reaches the recess 52. Thus, while the spring 60 will hold the sleeve 40 at the locked position so that the security door guard is held rigid by the sleeve, the sleeve 40 is retractable by manipulation of the knob 71 from the outside face of the door. When the keyed lock of the doorknob 71 is operated and the doorknob is turned, the resulting rotation of the inside lever on the doorknob pulls on the wire 61 retracting the locking sleeve 40 into the member 21*a*. When the sleeve 40 is fully retracted to the position of FIG. 6, the spring 90 will begin to pull the security door guard section 20 toward the wall face 12 so that the door guard folds allowing the door to be opened from the outside.

Figure 7:
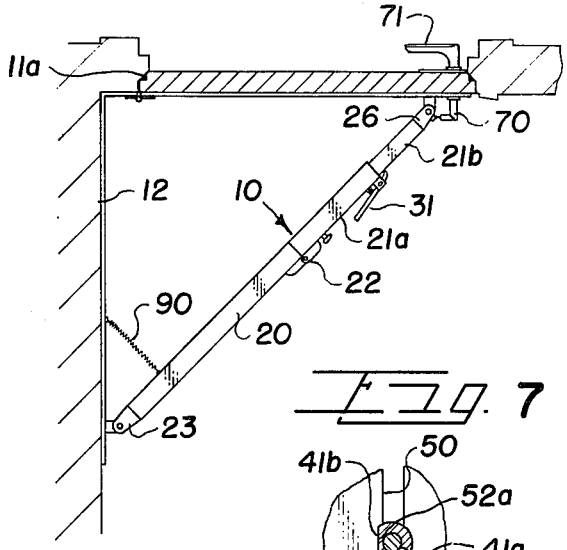
FIG. 7 is a view in section and elevation similar to FIG. 2 showing an alternate arrangement for mounting the door and connection of the door guard.

FIG. 7 illustrates a slightly modified form of door and door frame wherein the door is provided with a beveled outside edge surface 11*a* which may be suitably faced with a gasket material, not shown, which will better seal the door for improved heating and air conditioning conditions.

It will now be seen that there has been described and illustrated a new and improved security door guard for protecting against unauthorized entry through a door. The guard is operable from both inside and outside of the door. The guard does not obstruct the floor but rather is up away from an area in which the occupant walks in passing the door.

FIGS. 10–13 show a more simplified form of door guard brace 100 which requires fewer moving parts and thus may be manufactured more economically than the brace 10 while retaining the same basic functions. Referring to FIG. 10 the brace 100 includes a telescoping and folding assembly formed by a section 101 and a section 102 which is formed by telescoping members 103 and 104. The section member 103 is connected with the section 101 by a hinge 105 secured between the sections 101 and 103 on the side away from the door 11 so that the sections may fold inwardly toward the door as illustrated in FIG. 13. The sections 101 and 103 are also connected together along the side face adjacent to the door 11 by a hinge type assembly formed by interlocking members 110 and 111 removably secured together by a pin 112. As discussed hereinafter the pin 112 remains in place as shown in FIGS. 10 and 11 when the brace 100 is secured in position in a straight relationship for bracing or propping the door 11 closed. The brace section 101 is pivotally secured along an end portion 101*a* to a bracket 113 connected with the wall face 12. The member 104 telescopes into the member 103 to permit partial door opening as represented in FIG. 12. As shown by the broken lines in FIG. 10 the member 104 is slightly shorter than the member 103 and is pivotally connected to a bracket 114 secured with the inside lock plate 83 on the inside face of the door 11. The member 104 has a flange or collar 115 to limit the extent to which the member 104 may telescope into the member 103. This telescoping movement is permitted for partial door opening. The length of the internal telescoping member 104 relative to the length of the member 103 is such that when the member 104 is telescoped fully into the member 103 up to the collar 115 the inward end portion of the member 104 telescopes into the member 101 so that the brace is quite rigid at the hinge preventing any folding of the brace during partial door opening.

In operation the brace 100 is secured as shown in FIG. 10 with the locking pin 112 in place between the members 110 and 111 bracing the door 11 closed except when partial opening is desired as shown in FIG. 12.

The door 11 may be opened to the slightly ajar position of FIG. 12 by simply swinging the door inwardly until the member 104 telescopes into the member 103 up to the collar 115 which engages the outward end edge of the member 103. At this position the inward end of the telescoping member 104 extends through the hinged connection between the members 101 and 103 locking the brace against folding so that the door cannot be opened farther than the slightly ajar position shown in FIG. 12.

When full opening of the door is sesired, the pin 112 is removed and allowed to hang free on the chain 120. The brace is pressed manually toward the door at the hinge 105 so that the brace folds inwardly at the hinge allowing the door to open as illustrated in FIG. 13. When reclosure of the door is desired, it is swung back to the position of FIG. 10 with the brace being returned to the straight relationship illustrated in FIG. 10 and at which the connecting members 110 and 111 intermesh as shown in FIG. 11. The pin 112 is reinserted between the members 110 and 111 to lock the brace in a rigid nonfoldable condition.

While the door guards have been shown as being installed adjacent to a wall surface 12 which extends at ninety degrees to the door, it will be recognized that in the event that such a wall surface is not available a suitable brace, not shown, may be secured to provide a surface such as the wall surface 12, or alternatively, shelf arrangements of various types may be secured along the inside face of the wall in which the door 11 is mounted for purposes of providing a member to which the plate 81 may be secured.

What is claimed is:

1. A security door guard to preclude unauthorized entry through a door comprising: a first tubular section; a second tubular section; means providing a hinge connection between said first and second sections at adjacent ends thereof; locking means for rigidly securing said first and second sections together against folding comprising a sleeve movable within said sections at said connected adjacent ends; means for permitting said door guard to be reduced in length a predetermined amount for partially opening said door while holding said door against further opening; means for securing a free end of one of said sections with a face of a door; and means for securing a free end of the other of said sections with a supporting surface spaced from said door.

2. A security door guard to preclude unauthorized entry through a door comprising: a first tubular section; means for pivotally connecting a first end of said first section to a supporting surface spaced from an inside face of said door; a second tubular section including two telescoping portions for varying the length of said second section, one of said portions having a locking pawl operable with the other of said portions to lock second section at a desired length for partially opening said door; means for pivotally connecting a first end of said second section to the inside face of said door; hinge means for connecting adjacent second ends of said first and second sections together for folding said sections from a first rigid lock relationship to a folded unlock relationship; a locking sleeve within one of said sections and movable partially into the other of said sections at said second ends of said sections to lock said sections against folding; operator knob means on said lock sleeve for moving said sleeve from a release position in said one of said sections to a lock position in both of said sleeves; and spring means for biasing said locking sleeve toward said lock position.

3. A security door guard in accordance with claim 2 including means for releasing said locking sleeve from the outside face of said door.

* * * * *